US005269376A

United States Patent [19]

Gadelle et al.

[11] Patent Number: 5,269,376

[45] Date of Patent: Dec. 14, 1993

[54] METHOD FOR FAVORING THE PRODUCTION OF EFFLUENTS OF A PRODUCING ZONE

[75] Inventors: Claude Gadelle, Rueil-Malmaison; Jacques Lessi, Maule, both of France

[73] Assignee: Institut Francais Du Petrole, Rueil-Malmaison, France

[21] Appl. No.: 787,660

[22] Filed: Nov. 4, 1991

[30] Foreign Application Priority Data

Nov. 2, 1990 [FR] France ..... 90 13691

[51] Int. Cl.[5] ..... E21B 43/12

[52] U.S. Cl. ..... 166/370; 166/50; 166/369

[58] Field of Search ..... 166/50, 370, 369

[56] References Cited

U.S. PATENT DOCUMENTS

| | | | |
|---|---|---|---|
| 3,638,731 | 2/1972 | Driscoll | 166/369 |
| 4,020,901 | 5/1977 | Pisio et al. | 166/50 |
| 4,460,044 | 7/1984 | Porter | 166/50 X |
| 4,565,245 | 1/1986 | Mims et al. | 166/50 |
| 4,640,359 | 2/1987 | Livesey et al. | 166/50 X |
| 4,714,117 | 12/1987 | Dech | 166/50 X |
| 4,878,539 | 11/1989 | Anders | 166/50 X |
| 5,111,883 | 5/1992 | Savery | 166/370 X |

*Primary Examiner*—Hoang C. Dang

*Attorney, Agent, or Firm*—Antonelli, Terry, Stout & Kraus

[57] ABSTRACT

A deflected drain (2) drilled in a producing zone (1) is equipped for the production of effluents and fitted with a perforated casing (3) and with a tubing (4). A depression is applied in different locations by selectively changing the position of the application points in relation to these locations. The position of the suction ports and/or the area thereof is varied through the selective opening of valves (8) or by displacing the inlet of the tubing (4). A tubing and/or a casing with perforations such that a determined distribution of the depression is obtained can be used. The depression can be produced by a pumping assembly (5) intercalated on the production tubing (4).

5 Claims, 2 Drawing Sheets

METHOD FOR FAVORING THE PRODUCTION OF EFFLUENTS OF A PRODUCING ZONE

BACKGROUND OF THE INVENTION

The present invention relates to a method for favouring, by causing a depression, the production of effluents of a producing zone crossed by at least one deflected well or drain, such as a petroliferous zone. What is called a deflected well is any well at least part of which is substantially horizontal or little inclined in relation to the horizontal.

One of the interests of deflected wells is to allow a better scavenging of the oil effluents contained in the formations crossed and thereby to improve recovery.

Optimum recovery, for a given scavenging mechanism, is obtained when the scavenging front moves parallel to the deflected drain. The regularity of the scavenging front is sometimes difficult to keep because of heterogeneities of the reservoir such as fractures or channels, etc, changes in the drain geometry or disturbances linked to the flows in the drain such as pressure drops.

A well-known method for scavenging a producing zone consists in taking down therein a pumping device to suck out the effluents when the pressure in the formation becomes insufficient. The deflected well crossing the producing zone is equipped with a casing that is perforated in the part thereof which crosses the producing zone. A tubing is taken down into the zone to be activated. If necessary, a pump is intercalated on the tubing in order to produce a depression. An example of a pumping device is for example described in French patent application EN. 90/08,270. The depression caused by such a tubing is maximal in proximity to the lower end thereof and, because of the pressure drops, it decreases rapidly with the distance, so that the suction pressure quickly becomes insufficient to obtain a correct scavenging of the producing zone.

It is often difficult, in practice, to increase the depression at the lower outlet of the tubing in order to obtain a sufficient depression at all the points of the zone to be activated, either for reasons linked with the pumping assembly proper or because of the structure of the activated zone. As a matter of fact, in some basins, the layer containing the oil is relatively thin. It is bordered on one side with a gas accumulation or an aquifer. It may also lie between a gas accumulation and an aquifer. In this case, too strong a depression at the outlet of the tubing has the effect of also bringing in the gas or the water from the adjacent layers.

SUMMARY OF THE INVENTION

The method according to the invention allows, by creating a depression, to favour the production of effluents by a producing zone crossed by at least one deflected well or drain into which a tubing whose lower part at least is fitted with openings is taken down.

It comprises the selective varying of the extent of the depression in at least one location of the tubing by selectively changing the position of the openings where the depression is applied in relation to said location and/or the area of the openings where this depression is applied.

According to an embodiment procedure, the method comprises the control of the depression in at least one location of the well by adapting the pressure drop undergone by the effluents produced between this location and said openings.

The pressure drop appropriate to said location is obtained for example by using a tubing fitted with at least one opening for applying the depression and by varying the length of the path between said location and an opening of the tubing and/or the section of said opening.

To that effect, the tubing can also be fitted with a plurality of openings distributed on the length thereof and with means for varying the section of at least part of the openings, the method comprising in this case selecting at least one of said openings whose distance from said location and/or whose section are selected in order to obtain a depression at said location.

According to another implementing example, the method can comprise the use of a perforated suction tubing and/or of a perforated casing, the distribution of the perforations and the areas thereof being selected in order to obtain a determined distribution of the depression.

According to an implementing procedure, the method according to the invention can comprise the use of a suction means such as a pumping assembly in order to increase the depression applied to the formation.

With the proportioning of the depression obtained by displacing the suction points in relation to the different locations along the drain or by varying the suction areas, it is possible to adapt the activating according to the configuration of the producing zone and/or of the drain crossing it.

BRIEF DESCRIPTION OF THE DRAWINGS

Other features and advantages of the method according to the invention will be clear from reading the description hereafter of the embodiment procedures given by way of non limitative examples, with reference to the accompanying drawings in which.

DESCRIPTION OF THE PREFERRED EMBODIMENTS

Figure 1:
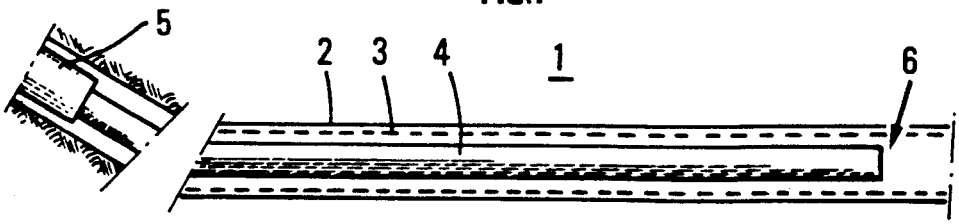
FIG. 1 diagrammatically shows a part of a production drain where a pumping activation equipment is installed.
Figure 2:
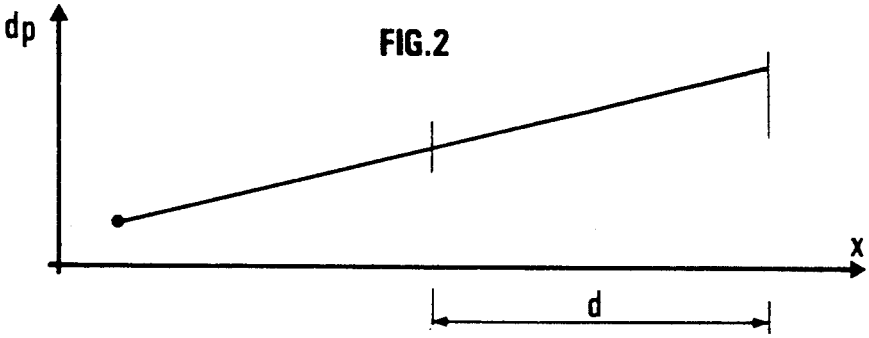
FIG. 2 shows the variation of the pumping depression along the drain when the pumping tube only comprises one end opening.

The method relates to the scavenging of a producing zone by creating a depression in a formation 1 brought into production. The formation is crossed (FIG. 2) by a deflected well or drain 2 whose lower part is horizontal or little inclined in relation to the horizontal. The well is generally fitted with a perforated casing 3 in the part thereof crossing the producing zone. A production-tubing 4 is taken down into the zone to be activated. A pump 5 is intercalated on the tubing in order to produce a depression. An example of a pumping device is for example described in French patent application EN.

90/08,270. The depression dp produced is maximal in proximity to the lower end 6 of the tubing 4 (FIG. 2) and, because of the pressure drops, it decreases with the distance d (FIG. 2), so that the suction pressure becomes insufficient to obtain a correct scavenging of the producing zone.

As it has been shown above, it is often difficult in practice to increase the depression at the lower outlet of the tubing in order to obtain a sufficient depression at all the points of the zone to be activated, either for reasons linked with the pumping assembly when the well brought into production is to be activated, or because of the structure of the activated zone where the layer containing the oil is relatively thin and boldered on one side with a gas accumulation or an aquifer, or lies between a gas accumulation and an aquifer.

A first implementing procedure of the method consists in displacing the lower end of the tubing 4 coming out into the producing zone, so that a depression sufficient for favouring the oil inflows with a good scavenging of the zone but still without producing any other undesirable inflows, is obtained in any location of the drain. With this embodiment procedure, use is made of the relative position of the drain locations in relation to the suction opening.

Figure 3:
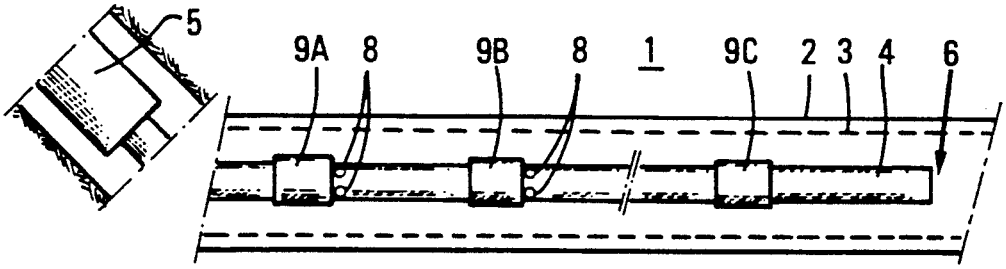
FIG. 3 shows a first implementing procedure of the method where a means for controlling the suction, allowing a better scavenging of the producing zone, is used.
Figure 4:
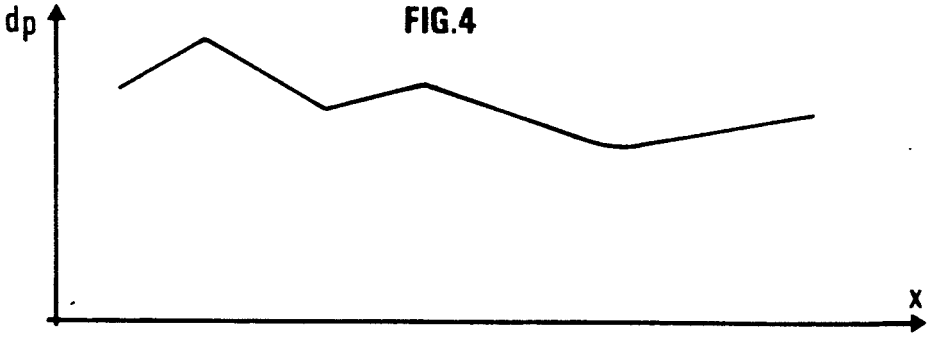
FIG. 4 shows an example of the better controlled variation obtained with the control means of FIG. 3, and FIG. 5 diagrammatically shows another appropriate means for obtaining a better scavenging of a producing zone.

A second implementing procedure of the method consists in using a tubing 7 whose part crossing the producing zone is fitted with a plurality of openings 8 (FIG. 3) opening selectively. A tubing fitted with lateral openings which can be concealed and uncovered on request by activating valves 9 such as sliding sleeve valves as described in the published patent application FR 2,626,614 can be used for example. The sliding of the sleeve allows to uncover openings 8 either partly (valve 9A) or totally (valve 9B) With a tubing fitted with multiple openings, the selective opening of one of the valves has the effect of locally increasing the depression (FIG. 4) and of regularizing the scavenging in proximity to the new opening.

Use can be made of two factors influencing the obtained pressure drop in order to obtain a given depression in a location of the production tubing. The first factor is the distance between the location and the suction opening 6,8, and the one of the lateral openings of the tubing which is at the appropriate distance can be selected. The second factor is the suction area which can be modified by opening more or less one of the valves 9 and/or by modifying the number of open valves.

It is also possible to combine the two embodiment procedures by displacing more or less along the drain a tubing fitted with controlled openings.

Figure 5:
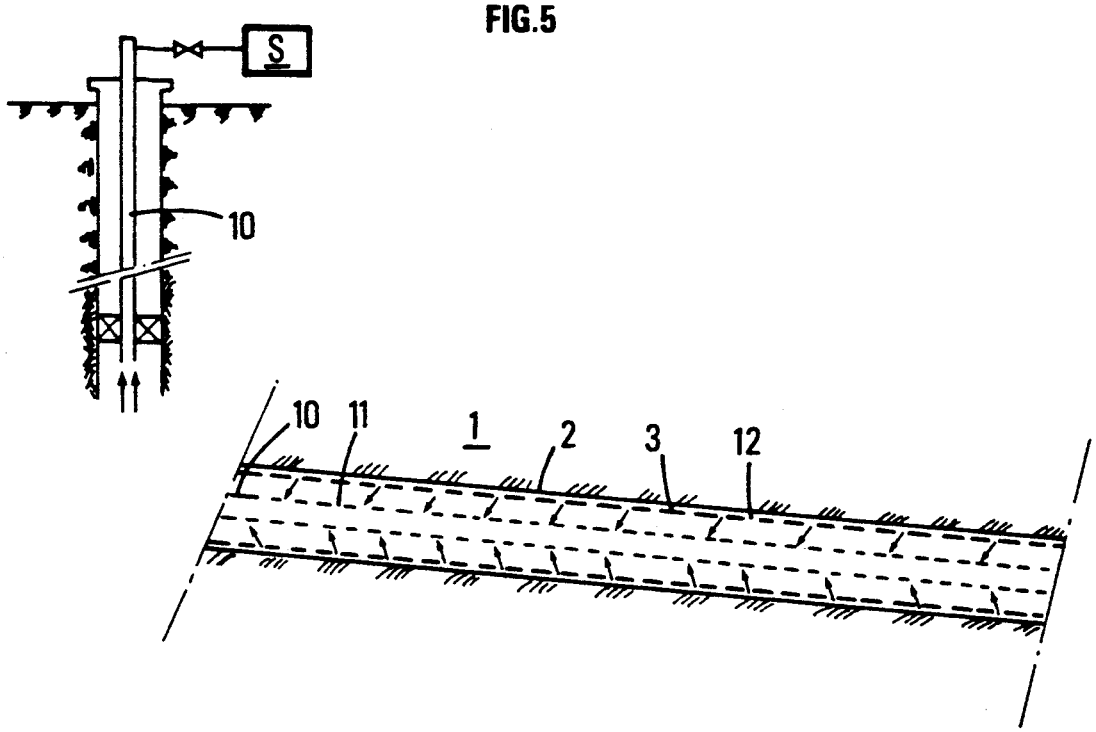

According to another embodiment procedure (FIG. 5), a tubing 10 perforated on part of the length thereof with a distribution of the lateral perforations 11 variable along the tubing is used. The density of the perforations and/or the areas thereof are selected to obtain a distribution of the depression adapted to the configuration of the well.

A casing 3 fitted with lateral perforations with a distribution of perforations 12 variable along the casing, in order to obtain an appropriate distribution of the depression along the drain, could be used without departing from the scope of the invention.

We claim:

1. A method for selectively improving production of effluents out of a subterranean producing zone penetrated by at least one deflected well provided with a casing perforated with orifices distributed all along said producing zone by disposing a tubing string with a lower part fitted with at least one opening provided with means for controlling a cross-sectional area thereof and modulating a negative pressure applied to a determined part of the well where improvement of production is needed by moving said at least one opening to a position at a selected distance from said part of the well and by adjusting said area whereby a pressure drop results over said selected distance with respect to the pressure prevailing at said opening which is compatible with the needed negative pressure.

2. A method for selectively improving production of effluents out a subterranean producing zone penetrated by at least one deflected well comprising positioning in said deflected well a casing perforated with orifices distributed all along said producing zone, disposing a tubing string with an elongated part fitted with several openings at least one of said openings being provided with means for controlling the opening area, and modulating the distribution of pressure applied locally all along said producing zone by positioning said openings to respective positions along said deflected well and controlling said at least one opening area whereby combined pressure drops over the distances between said openings and any point of the deflected well results in a pressure distribution compatible with the needed improvement.

3. A method for selectively improving production of effluents out a subterranean producing zone penetrated by at least one deflected well comprising positioning in said deflected well a casing perforated with orifices distributed all along said producing zone, disposing a tubing string with an elongated part fitted with a determined distribution of openings, at least one of said openings being provided with means for controlling the opening area, and modulating the distribution of pressure applied locally all along said producing zone by positioning said distribution of openings to respective positions along the deflected well and controlling said at least one opening area whereby combined pressure drops over the distances between said openings and any point of the deflected well results in a pressure distribution compatible with the needed improvement.

4. A method according to according to any one of claims 1 to 3 comprising providing said casing perforated with openings with a distribution of said openings that is selected for obtaining a predetermined distribution of pressure along said deflected well.

5. A method according to any one of claims 1 to 3 comprising using pumping means for increasing a negative pressure applied to the producing zone.

* * * * *